US005927198A

United States Patent [19]

Tada

[11] Patent Number: 5,927,198

[45] Date of Patent: Jul. 27, 1999

[54] SHEET-FED OFFSET PRINTING PRESS WITH GROOVED PAPER CONVEY CYLINDER

[75] Inventor: Katsuo Tada, Ibaragi, Japan

[73] Assignee: Komori Corporation, Japan

[21] Appl. No.: 09/062,602

[22] Filed: Apr. 17, 1998

[30] Foreign Application Priority Data

Apr. 24, 1997 [JP] Japan ..... 9-107136

[51] Int. Cl.[6] ..... B41F 13/24

[52] U.S. Cl. ..... 101/232; 101/420

[58] Field of Search ..... 101/232, 230, 101/240, DIG. 49, 418–420, 422, 407.1; 271/277

[56] References Cited

U.S. PATENT DOCUMENTS

| | | | |
|---|---|---|---|
| 4,242,959 | 1/1981 | Jeschke et al. | 101/420 |
| 4,796,529 | 1/1989 | Mathes | 101/230 |
| 5,026,045 | 6/1991 | Wirz et al. | 271/277 |
| 5,042,383 | 8/1991 | Wirz | 101/420 |
| 5,415,098 | 5/1995 | Ward | 101/493 |
| 5,772,203 | 6/1998 | Masek et al. | 271/275 |

FOREIGN PATENT DOCUMENTS

| | | |
|---|---|---|
| 0641651A1 | 3/1995 | European Pat. Off. . |
| 61-74439 | 5/1986 | Japan . |
| 7-35041 | 6/1995 | Japan . |

*Primary Examiner*—Ren Yan
*Assistant Examiner*—Dave A. Ghatt
*Attorney, Agent, or Firm*—Blakely Sokoloff Taylor & Zafman

[57] ABSTRACT

A sheet-fed offset printing press with a convertible press mechanism includes a convertible cylinder, an impression cylinder, converting grippers and suckers, and grooves. The convertible cylinder conveys a paper sheet downstream with respect to a paper convey direction in a converted state. The impression cylinder is in contact with the convertible cylinder on an upstream side with respect to the paper convey direction, and conveys the paper sheet to the convertible cylinder. The converting grippers and suckers are provided to the convertible cylinder and separate the paper sheet wound on a circumferential surface of the impression cylinder and convert the separated paper sheet. The grooves are formed in an outermost circumferential surface of the impression cylinder including a circumferential surface of the impression cylinder. The outermost circumferential surface of the impression cylinder comes into direct contact with the paper sheet which is conveyed to the convertible cylinder.

10 Claims, 6 Drawing Sheets

SHEET-FED OFFSET PRINTING PRESS WITH GROOVED PAPER CONVEY CYLINDER

BACKGROUND OF THE INVENTION

The present invention relates to a sheet-fed offset printing press with a convertible press mechanism, which has a convertible cylinder disposed between upstream and downstream paper convey cylinders with respect to a paper convey direction to enable one-sided printing and double-sided printing with one printing press.

Along with a variety of printing techniques, a sheet-fed offset printing press with a convertible press mechanism, which is capable of performing one-sided and double-sided printing has been proposed and put into practice. As an example of such a offset printing press, a sheet-fed offset printing press with a convertible press mechanism, which has upstream and downstream impression cylinders with respect to a paper convey direction, and a convertible cylinder disposed between these two cylinders, is disclosed in Japanese Utility Model Laid-Open No. 7-35041. This printing press will be described.

FIG. 7 shows the cylinder arrangement of the conventional sheet-fed offset printing press with the convertible press mechanism disclosed in this reference, which is set in the double-sided printing state. Referring to FIG. 7, in each of adjacent printing units, e.g., of a first printing unit 1 and a second printing unit 2, a plate cylinder 3 on which a plate is mounted and a blanket cylinder 4 on which a blanket is wound are arranged to be in contact with each other. Impression cylinders 5 and 6 each having a diameter twice that of the plate cylinder 3 are respectively arranged to be in contact with the blanket cylinders 4 of the upstream and downstream printing units 1 and 2 with respect to the paper convey direction. A convertible cylinder 7 having a diameter twice that of the plate cylinder 3 is arranged between the impression cylinder 5 of the printing unit 1 and the impression cylinder 6 of the printing unit 2, such that its circumferential surface is in contact with the impression cylinders 5 and 6.

A plurality of sets of gripper units 8 each consisting of a gripper and a gripper pad and opened/closed by a cam mechanism are arranged at portions that equally halve the outer circumferential portion of the impression cylinder 5 in the circumferential direction, to be aligned in the axial direction of the impression cylinder 5. A plurality of sets of gripper units 9 each opened/closed by a cam mechanism are arranged at portions that equally halve the outer circumferential portion of the impression cylinder 6 in the circumferential direction, to be aligned in the axial direction of the impression cylinder 6.

A pair of converting grippers 10 each opened/closed by a cam mechanism and a pair of suckers 11 connected to a suction air source, e.g., a pump (not shown), are arranged on the outer circumferential portion of the convertible cylinder 7. The corresponding converting gripper 10 and sucker 11 form a pair, and the respective pairs of converting grippers 10 and suckers 11 are arranged at portions that equally halve the outer circumferential portion of the convertible cylinder 7 in the circumferential direction, to come close to each other and be aligned in the axial direction of the convertible cylinder 7.

When one-sided printing is to be performed, the phases of the respective cylinders are set such that, upon rotation of the cylinders 5, 6, and 7, the converting grippers 10 oppose the gripper units 8 and the gripper units 9. When double-sided printing is to be performed, as in FIG. 7, the phases of the respective cylinders are set such that, upon rotation of the cylinders 5, 6, and 7, the paper trailing end of a paper sheet 12 gripped by the gripper units 8 corresponds to the suckers 11 and the converting grippers 10 correspond to the gripper units 9.

The operation of the sheet-fed offset printing press having the above arrangement will be described with reference to FIG. 8. In the case of double-sided printing, when the cylinders 5, 6, and 7 are rotated, the upper surface of the paper sheet 12 gripped by the gripper units 8 and conveyed is subjected to printing as the paper sheet 12 passes between the blanket cylinder 4 and the impression cylinder 5. The paper sheet 12, the upper surface of which has been subjected to printing, passes between the cylinders 5 and 7 without being gripped by the converting grippers 10 at its gripper end, and is wound on the lower circumferential surface of the impression cylinder 5.

When the paper trailing end of the paper sheet 12 wound on the impression cylinder 5 reaches the contact point between the cylinders 5 and 7, that is, when the corresponding suckers 11 reach the line connecting the center of the impression cylinder 5 and the center of the convertible cylinder 7, the paper trailing end of the paper sheet 12 is drawn by these suckers 11. While the paper trailing end of the paper sheet 12 is drawn by the suckers 11, when the convertible cylinder 7 continues rotation, the suckers 11 move round along the outer side of the circumferential surface of the convertible cylinder 7 while rotating counterclockwise, as indicated by reference numerals 11A to 11G in FIG. 8.

When the suckers 11 hold the paper trailing end and move to the position indicated by the reference numeral 11G in this manner, the paper sheet 12 is turned. At this time, until the suckers 11 are located at the contact point between the cylinders 5 and 7 and draws the paper trailing end of the paper sheet 12, the gripper units 8 of the impression cylinder 5 are kept closed and do not release the paper sheet 12. Thereafter, the suckers 11 draw the paper trailing end of the paper sheet 12, and the gripper units 8 are opened simultaneously to release the paper sheet 12.

When the suckers 11 that draw the paper sheet 12 reach the position indicated by reference numeral 11G, air suction from the suckers 11 is interrupted due to the action of the rotary valve, and the paper sheet 12 is released. Simultaneously, the paper sheet 12 released from the suckers 11 is gripped by the gripping surfaces of the converting grippers 10.

When the convertible cylinder 7 is further pivoted and the converting grippers 10 oppose the corresponding gripper units 9 at the position of the contact point between the convertible cylinder 7 and impression cylinder 6, the paper sheet 12 is transferred from the converting grippers 10 of the convertible cylinder 7 to the corresponding gripper units 9 of the impression cylinder 6. Thereafter, the paper sheet 12 is gripped by the gripper units 9 of the impression cylinder 6, and its lower surface is subjected to printing while the paper sheet 12 is being conveyed.

After the paper sheet 12 is transferred to the converting grippers 10 at the position indicated by the reference numeral 11G, the suckers 11 pivot through substantially 90° until they reach the contact point between the cylinders 7 and 6, and move in the radial direction to retract in the circumferential surface of the convertible cylinder 7. Therefore, the suckers 11 will not interfere with the circumferential surface of the impression cylinder 6.

When the convertible cylinder 7 is further rotated, the suckers 11 move from the contact point between the cylinders 6 and 7 to the contact point between the cylinders 7 and 5. During this period of time, the suckers 11 move in the circumferential direction of the convertible cylinder 7 while they are pivot by a sucker pivoting cam (not shown) through substantially 360°. Because of the action of a sucker moving cam, the suckers 11 ride over the corresponding converting grippers 10, and move in the radial direction of the convertible cylinder 7 to project from and retract in the circumferential surface of the convertible cylinder 7.

When performing a switching operation from double-sided printing to one-sided printing, the phases of the upstream cylinders are adjusted with respect to the paper convey direction including the impression cylinder 5, such that the gripper units 8 of the impression cylinder 5 correspond to the converting grippers 10 of the convertible cylinder 7. In one-sided printing, when the cylinders 5, 6, 7, and the like are rotated, the paper sheet 12 which is conveyed as it is gripped by the gripper units 8 of the impression cylinder 5 is subjected to first-color printing while it passes through the contact point between the blanket cylinders 4 and impression cylinder 5 of the printing unit 1.

Thereafter, the paper sheet 12 is transferred from the gripper units 8 to the converting grippers 10, and is conveyed as it is wound on the lower circumferential surface of the convertible cylinder 7. The paper sheet 12 wound on the convertible cylinder 7 is transferred from the converting grippers 10 to the gripper units 9 of the impression cylinder 6 and is conveyed. When the paper sheet 12 passes through the contact point between the blanket cylinder 4 and impression cylinder 6 of the printing unit 1, the surface of the paper sheet 12 which has been printed by the printing unit 1 is subjected to second-color printing by the printing unit 2.

The operation described above is described in detail in E.P. 0641651A1.

In the conventional sheet-fed web offset printing press with the convertible press mechanism described above, in double-sided printing, to separate the paper sheet 12 wound on the circumferential surface of the upstream impression cylinder 5, its paper trailing end is separated by rotation of the convertible cylinder 7 and suction by the suckers 11. Since the gripping force effected by suction of the suckers 11 is limited as compared to the gripping force effected by the grippers, a sufficient gripping operation cannot be performed.

The paper sheet 12 which has passed through the contact point between the impression cylinder 5 and blanket cylinder 4 is in tight contact with the circumferential surface of the impression cylinder 5 because of the printing pressure applied between the impression cylinder 5 and blanket cylinder 4. The tight contact force applied to the circumferential surface of the impression cylinder 5 becomes particularly strong when performing printing on a coated printing paper sheet and when performing offset printing that uses dampening water. As a result, sometimes a so-called gripping failure occurs in which the paper trailing end of the paper sheet 12 cannot be gripped by the suckers 11 or even if it is gripped once, it is undesirably released.

In this case, when the paper sheet 12 which is failed to be gripped stays wound on the upstream impression cylinder 5, the next paper sheet lies on it, causing defective printing. When the paper sheet 12 which is failed to be gripped drops in the printing press, the dropped paper sheet 12 is caught by another roller or cylinder to cause a printing trouble. This tendency is becoming more and more conspicuous as the operation speed of the printing press increases.

SUMMARY OF THE INVENTION

It is an object of the present invention to provide a sheet-fed offset printing press with a convertible press mechanism, in which a paper sheet gripping failure of a convertible cylinder is eliminated to prevent occurrence of defective printing or printing trouble.

In order to achieve the above object, according to the present invention, there is provided a sheet-fed offset printing press with a convertible press mechanism, comprising a convertible cylinder for conveying a paper sheet in a converted state downstream in a paper convey direction, a paper convey cylinder which is in contact with the convertible cylinder on an upstream side in the paper convey direction and conveys the paper sheet to the convertible cylinder, a convertible press mechanism provided to the convertible cylinder to separate the paper sheet wound on a circumferential surface of the paper convey cylinder and to convert the separated paper sheet, and a plurality of recesses formed in an outermost circumferential surface of the paper convey cylinder including a circumferential surface of the paper convey cylinder, the outermost circumferential surface of the paper convey cylinder coming into direct contact with the paper sheet which is conveyed to the convertible cylinder.

DESCRIPTION OF THE PREFERRED EMBODIMENT

The present invention will be described in detail with reference to the accompanying drawings.

Figure 1:
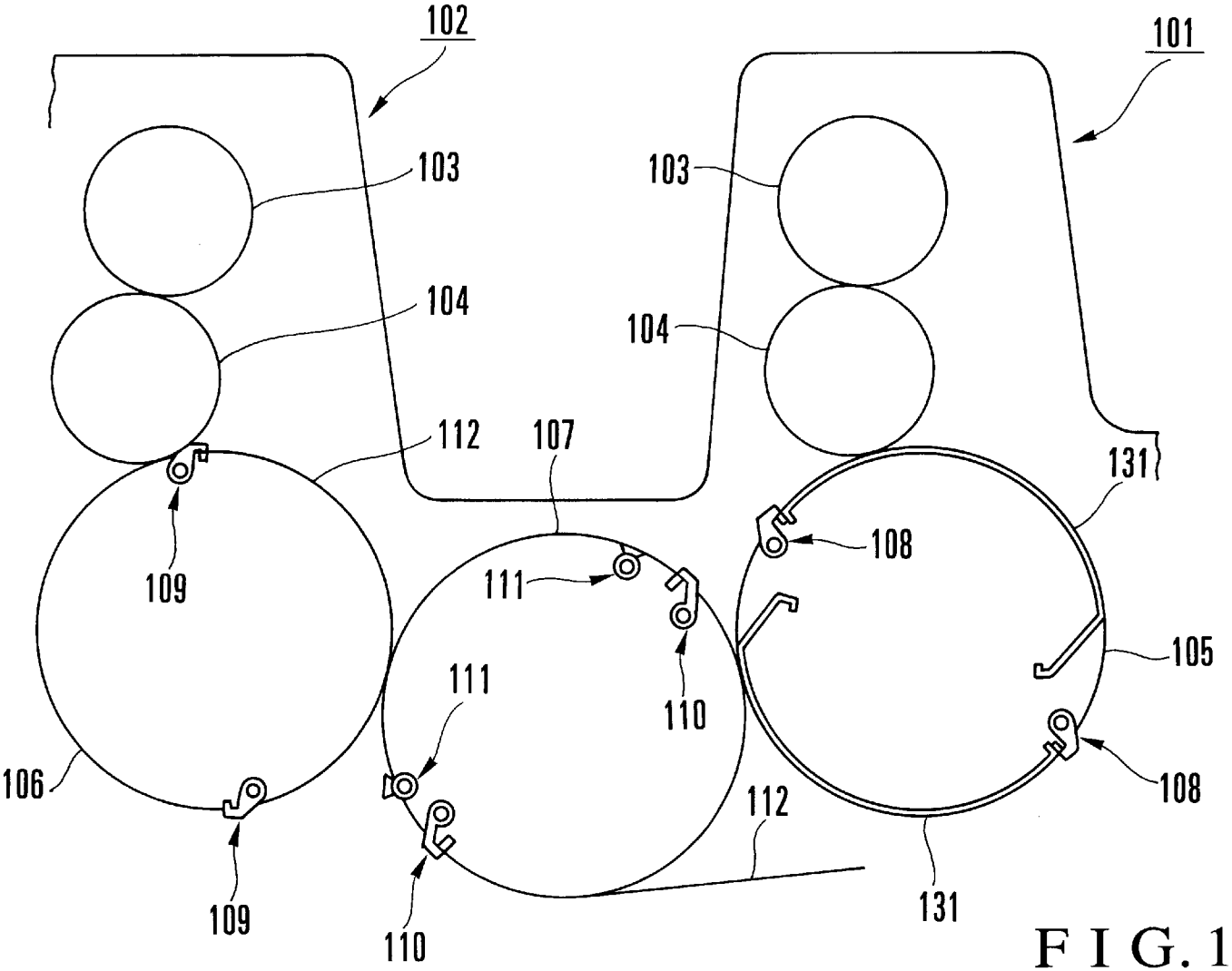
FIG. 1 is a side view showing the cylinder arrangement of a sheet-fed offset printing press with a convertible press mechanism according to the first embodiment of the present invention.

FIG. 1 shows the cylinder arrangement of a sheet-fed offset printing press with a convertible press mechanism according to the present invention. Referring to FIG. 1, in each of adjacent printing units, e.g., of a first printing unit 101 and a second printing unit 102, a plate cylinder 103 on which a plate is mounted and a blanket cylinder 104 on which a blanket is wound are arranged to be in contact with each other. Impression cylinders 105 and 106 each having a diameter twice that of the plate cylinder 103 are respectively arranged to be in contact with the blanket cylinders 104 of the upstream and downstream printing units 101 and 102 with respect to the paper convey direction. A convertible cylinder 107 having a diameter twice that of the plate cylinder 103 is arranged between the impression cylinder 105 of the printing unit 101 and the impression cylinder 106 of the printing unit 102 such that its circumferential surface is in contact with the impression cylinders 105 and 106.

A plurality of sets of gripper units 108 each consisting of a gripper and a gripper pad and opened/closed by a cam mechanism are arranged at portions that equally halve the outer circumferential portion of the impression cylinder or paper convey cylinder 105 in the circumferential direction, to be aligned in the axial direction of the impression cylinder 105. Tight contact preventive plates 131 (to be described later) are wound on the circumferential surface of the impression cylinder 105, which is in contact with the convertible cylinder 107 on the upstream side in the paper convey direction, between the two gripper units 108. A plurality of sets of gripper units 109 each opened/closed by a cam mechanism are arranged at portions that equally halve the outer circumferential portion of the impression cylinder 106 in the circumferential direction, to be aligned in the axial direction of the impression cylinder 106.

A pair of converting grippers 110 each opened/closed by a cam mechanism and a pair of suckers 111 connected to a suction air source, e.g., a pump (not shown), are arranged on the outer circumferential portion of the convertible cylinder 107. The corresponding converting gripper 110 and sucker 111 form a pair, and the respective pairs of converting grippers 110 and suckers 111 are arranged at portions that equally halve the outer circumferential portion of the convertible cylinder 107 in the circumferential direction, to come close to each other and be aligned in the axial direction of the convertible cylinder 107.

When one-sided printing is to be performed, the phases of the respective cylinders are set such that, upon rotation of the cylinders 105, 106, and 107, the converting grippers 110 oppose the gripper units 108 and the gripper units 109. When double-sided printing is to be performed, as in FIG. 1, the phases of the respective cylinders are set such that, upon rotation of the cylinders 105, 106, and 107, the paper trailing end of a paper sheet 112 gripped by the gripper units 108 corresponds to the suckers 111 and the converting grippers 110 correspond to the gripper units 109.

Figure 7:
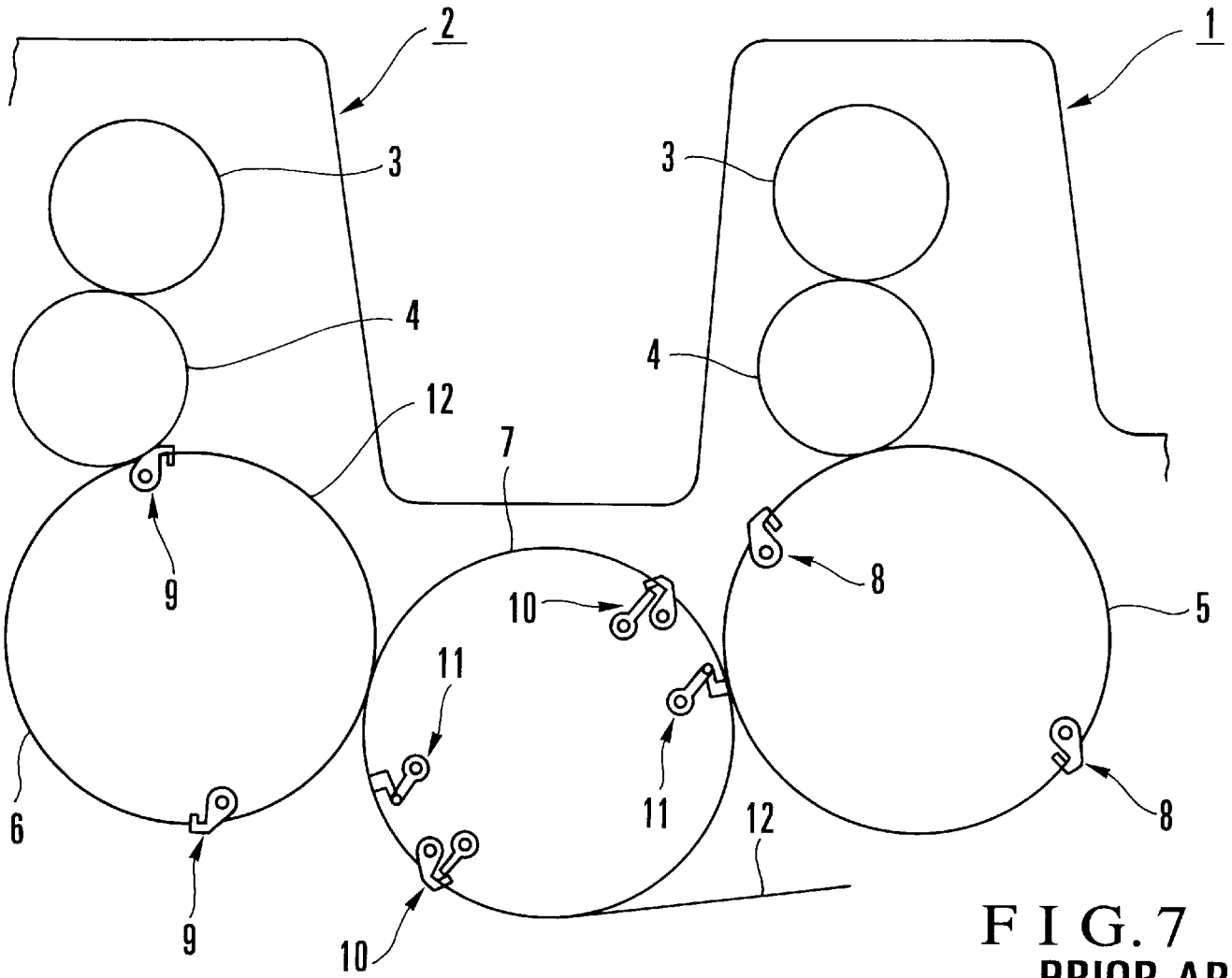
FIG. 7 PRIOR ART
FIG. 7 is a side view showing the cylinder arrangement of a conventional sheet-fed offset printing press with a convertible press mechanism.
Figure 8:
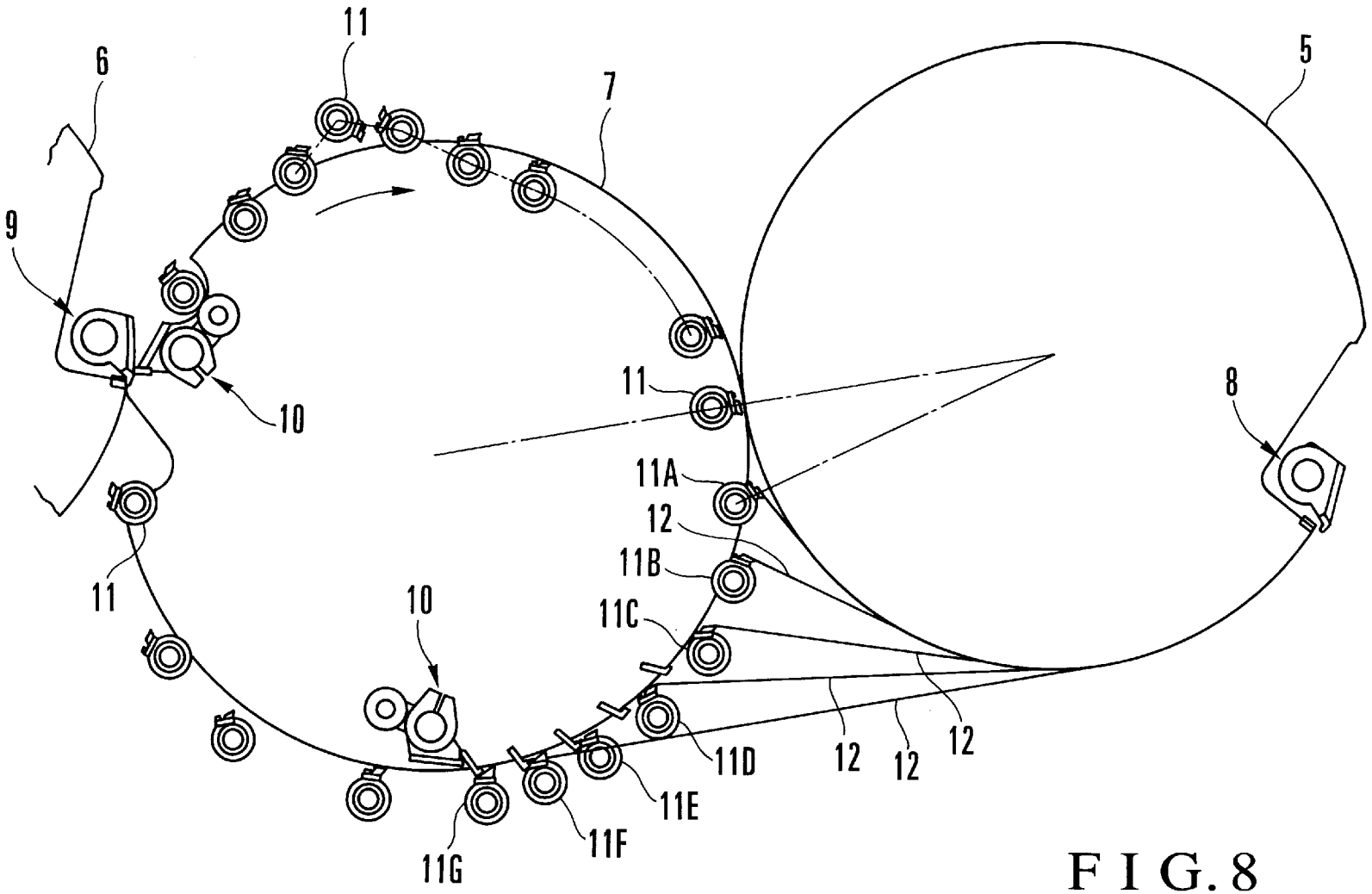
FIG. 8 PRIOR ART
FIG. 8 is an enlarged view of the main part for explaining a transfer operation to the convertible cylinder of the sheet-fed offset printing press shown in FIG. 7.

The double-sided and one-sided printing operations of the sheet-fed offset printing press having the above arrangement are completely identical to those described above with reference to FIGS. 7 and 8, and a detailed description thereof will thus be omitted.

The mounting structure of the plates 131 will be described with reference to FIGS. 2, 3, and 4A and 4B.

Figure 2:
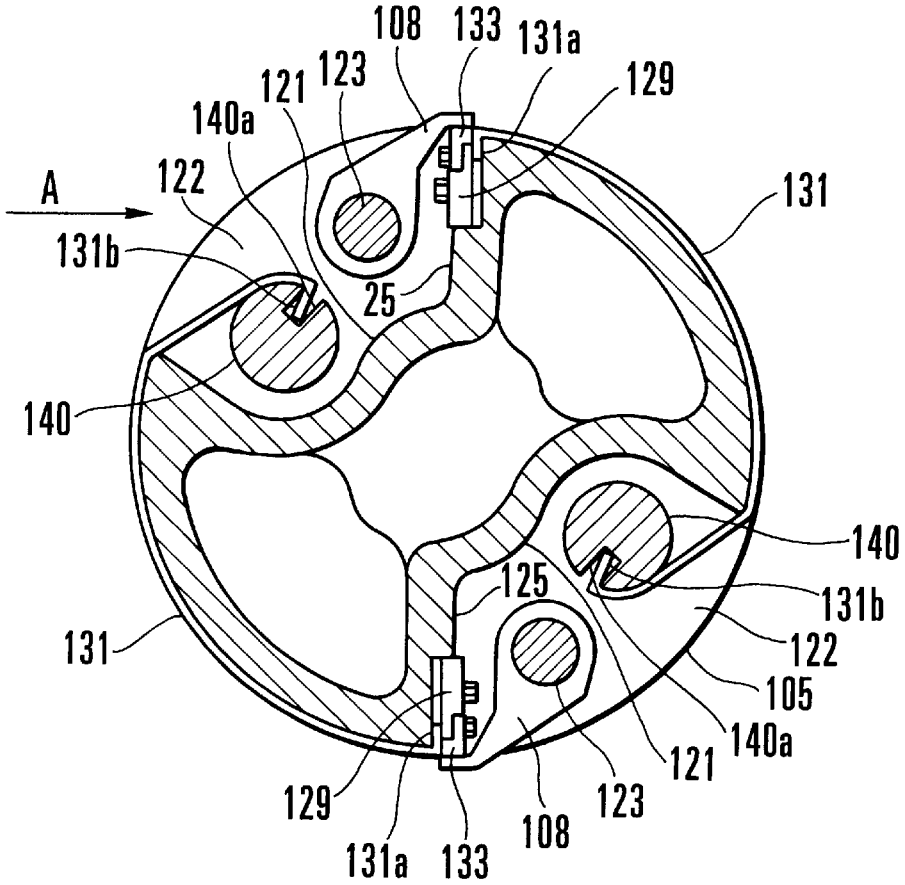
FIG. 2 is a sectional view of an impression cylinder on the upstream side of the convertible cylinder shown in FIG. 1.

Referring to FIG. 2, the impression cylinder 105 is casted for the purpose of weight reduction, and is formed into a skeleton. A pair of gaps 121 are formed in the outer circumferential surface of the impression cylinder 105 at positions phase-shifted from each other by 180° in the circumferential direction, and extend along the entire length of the cylinder 105. The two ends of each gap 121 are closed with a pair of circular disk-shaped bearers 122.

Figure 3:
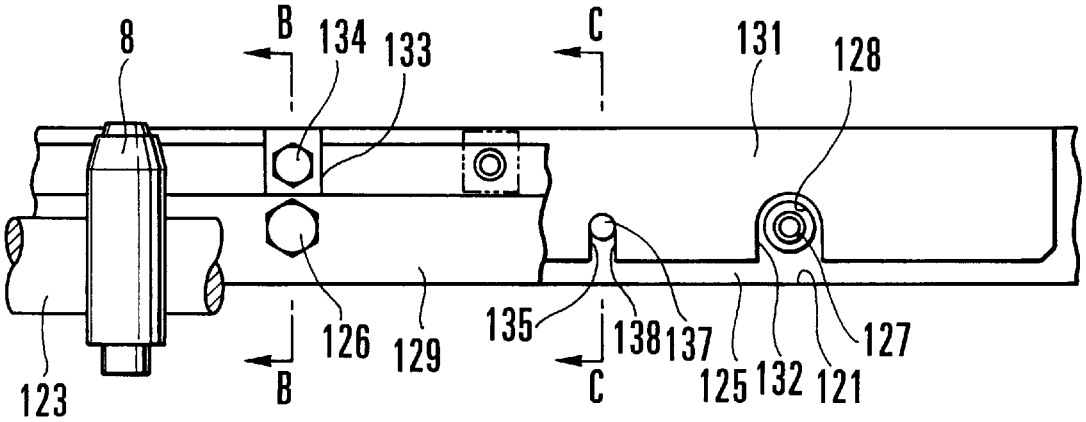
FIG. 3 is a view seen from the direction of an arrow A of FIG. 1.

A gripper shaft 123 extends in each gap 121 as it is axially supported by the bearers 122 and a bearing in the gap 121. The plurality of gripper units 108 are formed on the gripper shaft 123 to be aligned at a predetermined gap in the axial direction of the impression cylinder 105. The gripper units 108 are opened/closed by the reciprocal pivot motion of the gripper shaft 123 effected by a cam mechanism. A bolt hole 127 in which a bolt 126 is to be threadably engaged is formed in the stepped portion of a gripper unit 108 side wall surface 125 of the gap 121. As shown in FIG. 3, a large-diameter stepped portion 128 is formed in the opening portion of the bolt hole 127.

Figure 4B:
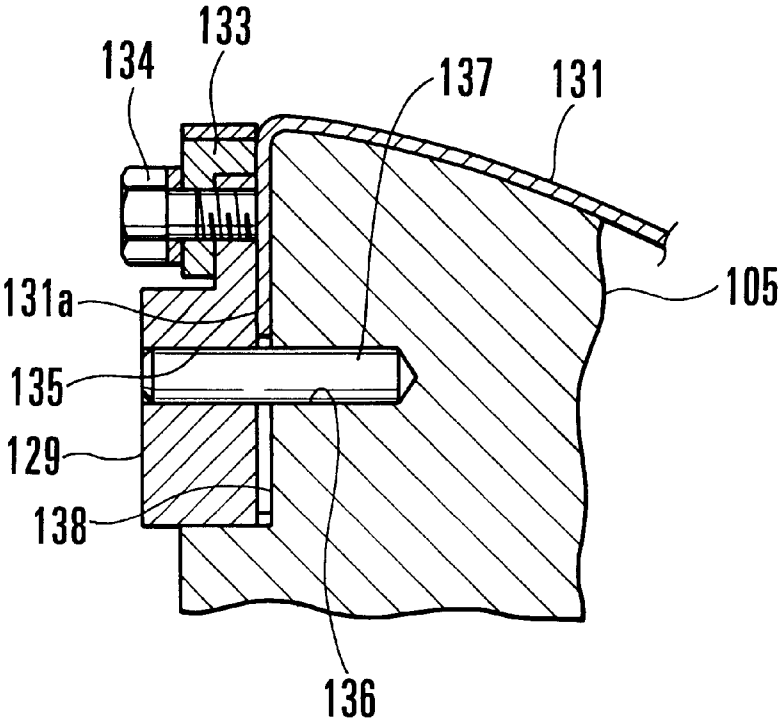
FIG. 4B is a sectional view taken along the line C—C of FIG. 3.
Figure 4A:
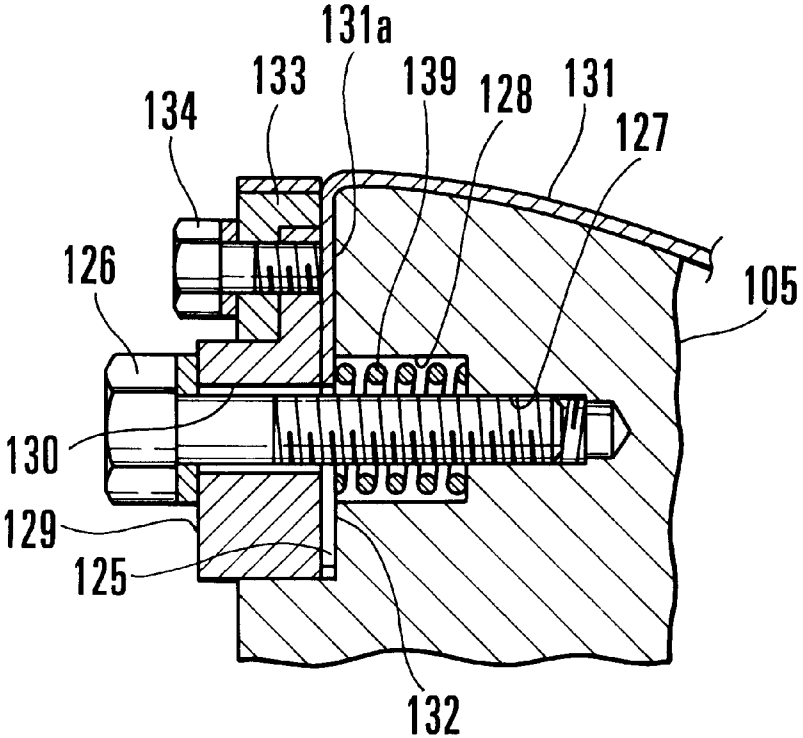
FIG. 4A is a sectional view taken along the line B—B of FIG. 3.

An elongated gripper pad bar 129 extends along the entire length of each gap 121. As shown in FIG. 4A, the gripper pad bar 129 has an L-shaped section. A through-hole 130 in which the bolt 126 is to be loosely inserted is formed in the gripper pad bar 129 to correspond to the bolt hole 127. The bolt 126 is threadably engaged in the bolt hole 127 to fix the gripper pad bar 129 to the wall surface 125. An insertion end portion 131*a* of each plate 131 mounted on the circumferential surface of the impression cylinder 105 is inserted between the gripper pad bar 129 and the wall surface 125 such that the bolt 126 is loosely inserted in the U-shaped groove 132 formed in the insertion end portion 131*a*, and is fixed to the wall surface 125 together with the gripper pad bar 129.

A plurality of gripper pads 133, each having an L-shaped section, for gripping the end portion of the paper sheet 112 together with the gripper units 108 are fixed to the thin-walled portion of the gripper pad bar 129 at a predetermined gap with bolts 134. As shown in FIG. 4B, pin holes 135 and 136 are correctly positioned and formed in the gripper pad bar 129 and the wall surface 125 to extend through them. A reference pin 137 is fitted in the pin holes 135 and 136. The reference pin 137 is fitted in the U-shaped groove 138 formed in the insertion end portion 131*a* of the plate 131. When forming the U-shaped groove 138, it is positioned to precisely correspond to the pin holes 135 and 136 and to fit on the reference pin 137. The insertion end portion 131*a* of the plate 131 is bent by precisely calculating its size from the abutting end of the U-shaped groove 138 abutting against the reference pin 137.

As shown in FIG. 4A, a compression coil spring 139 for biasing the gripper pad bar 129 in a direction to separate from the wall surface 125 is mounted in the large-diameter stepped portion 128 of the bolt hole 127. The U-shaped bolt groove 132 of the plate 131 is formed to have a large diameter so that it will not interfere with the compression coil spring 139.

The plate 131 having one insertion end portion 131*a* held by the gripper pad bar 129 is wound on the circumferential surface of the impression cylinder 105, and is guided to the other end portion of the other gap 121. In the other gap 121, a wrap-up rod 140 having an incision 140*a* extends as it is axially supported by the pair of bearers 122. The other insertion end portion 131*b* of the plate 131 is engaged in the incision 140*a*. When the wrap-up rod 140 is pivoted while regulating its reverse rotation with a ratchet mechanism or the like, the plate 131 is tightened to come into tight contact with the circumferential surface of the impression cylinder 105.

Figure 5:
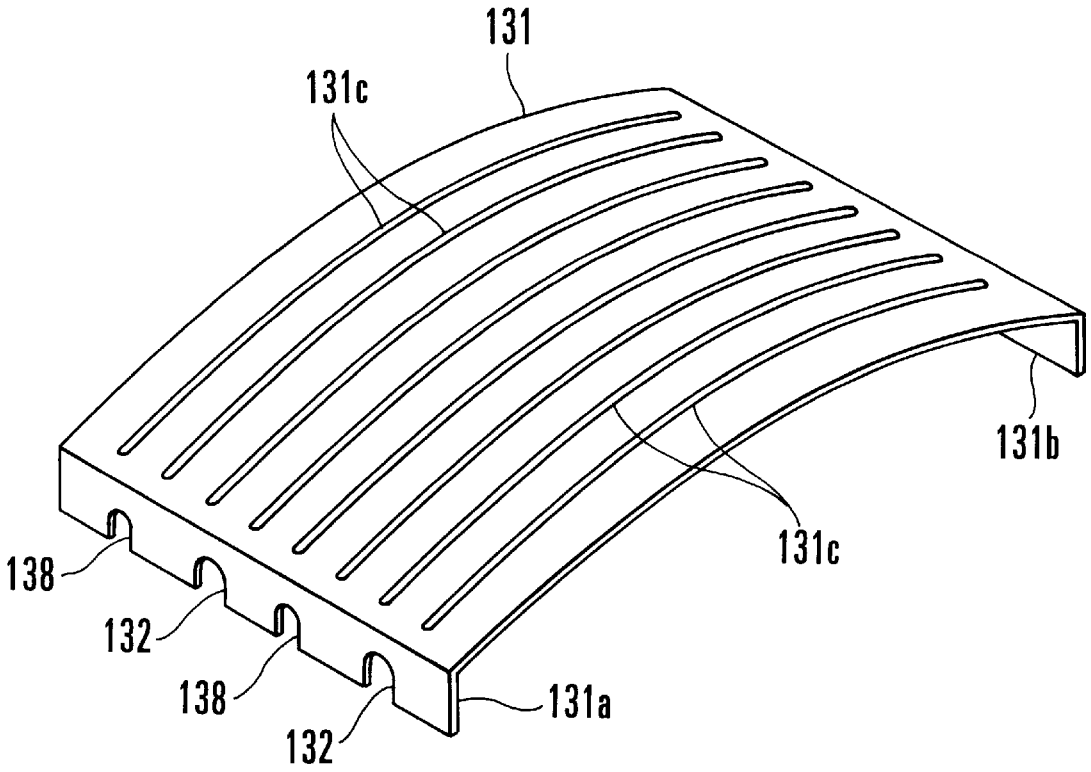
FIG. 5 is a perspective view showing an example of the tight contact preventive plate shown in FIG. 1.

FIG. 5 shows an example of the plate 131 mounted on the circumferential surface of the impression cylinder 105.

Referring to FIG. 5, the plate 131 is made of a metal thin plate entirely having flexibility, and has the insertion end portions 131*a* and 131*b* formed by bending its two ends at substantially a right angle. A plurality of elongated thin bottomed grooves 131*c*, extending toward the insertion end portions 131*a* and 131*b*, i.e., in the circumferential direction of the impression cylinder 105, are formed between the insertion end portions 131*a* and 131*b* to be parallel to each other. The wide U-shaped grooves 132 and the narrow U-shaped grooves 138 are alternately formed in the insertion end portion 131*a* of the plate 131.

In the sheet-fed web offset printing press having the above arrangement, when mounting the plate 131 on the circumferential surface of the impression cylinder 105, first, the bolt 126 is inserted in the through-hole 130 of the gripper pad bar 129 of each gap 121 and is temporarily fastened. At this time, the pin hole 135 in the gripper pad bar 129 fits on the reference pin 137, which is fitted in the pin hole 136 of the wall surface 125 of the gap 121 to extend upright, without backlash. Subsequently, one insertion end portion 131*a* of the plate 131, which is formed by bending at an accurate position with reference to the U-shaped groove 138 in advance, is inserted between the gripper pad bar 129 and wall surface 125, and the U-shaped groove 138 is engaged with the reference pin 137. At this time, the bolt 126 is fastened while urging the deep portion of the U-shaped groove 138 against the reference pin 137.

Since the gripper pad bar 129 and the plate 131 are accurately positioned, the plate 131 is wound on the circumferential surface of the impression cylinder 105. The other insertion end portion 131*b* is engaged in the incision 140*a* in the wrap-up rod 140, and thereafter the wrap-up rod 140 is pivoted to bring the plate 131 into tight contact with the circumferential surface of the impression cylinder 105. Since one end of the plate 131, i.e., the insertion end portion 131*a,* is accurately positioned, one side of the plate 131, i.e., the insertion end portion 131*b,* will not float from the circumferential surface of the impression cylinder 105. Also, the gripper pads 133 mounted on the gripper pad bar 129 are also positioned accurately.

To remove the plate 131 for exchange or the like, the wrap-up rod 140 is rotated in the reverse direction to loosen the plate 131, and the bolt 126 is loosened. Then, the gripper pad bar 129 is separated from the wall surface 125 by the spring force of the compression coil spring 139, to form a gap. When the plate 131 is pulled up, the U-shaped groove 138 and the reference pin 137 are disengaged from each other, and the plate 131 can be removed easily.

According to this embodiment, since the tight contact preventive plates 131 formed with a plurality of bottomed grooves 131*c* are mounted on the circumferential surface of the impression cylinder 105 located on the upstream side of the convertible cylinder 107, air staying in the bottomed grooves 131*c* is interposed between the surfaces of the plates 131 and the paper sheet 112 which has been subjected to printing between the blanket cylinders 104 and impression cylinder 105 and is in tight contact with the surfaces of the plates 131. Therefore, when the paper trailing end of the paper sheet 112 is drawn by the suckers 111 of the convertible cylinder 107 to separate the paper sheet 112 from the circumferential surface of the impression cylinder 105, a vacuum state between the paper sheet 112 and the surfaces of the plates 131 is prevented. As a result, generation of a negative pressure that interferes with the paper sheet 112 from being separated from the impression cylinder 105 is prevented.

Since the bottomed grooves 131*c* are formed in the plates 131, the contact area between the paper sheet 112 and the surfaces of the plates 131 is decreased. Hence, when the paper sheet 112 is separated from the circumferential surface of the impression cylinder 105 and comes into slidable contact with the surfaces of the plates 131, the contact resistance against the paper sheet 112 is reduced. When the paper trailing end of the paper sheet 112 is drawn by the suckers 111 of the convertible cylinder 107, no strong force that pulls back the paper sheet 112 to the impression cylinder 105 side is applied to the suckers 111 of the convertible cylinder 107. As a result, the paper sheet 112 will not fail to be gripped by the suckers 111, and the paper sheet 112 is prevented from dropping into the printing press or being left wound on the impression cylinder 105, thereby preventing occurrence of a printing trouble or defective printing.

According to the result of experiments done by the present inventor, it was confirmed that, when the plates 131 were mounted on the circumferential surface of the impression cylinder 105, as in the present invention, the paper sheet 112 was separated from the impression cylinder 105 better than in the conventional case wherein no plate 131 was mounted on the circumferential surface of the impression cylinder 105. In this case, according to the findings of the present inventor, along with rotation of the impression cylinder 105, air present between the paper sheet 112 and the circumferential surface of the impression cylinder 105 flowed smoothly in the circumferential direction of the impression cylinder 105, to further allow better separation of the paper sheet 112. Therefore, as shown in FIG. 5, it is preferable that the plurality of bottomed grooves 131*c* be formed in the plates 131 to extend in the circumferential direction of the impression cylinder 105.

According to one embodiment of the invention, the width of the bottomed grooves 131*c* is substantially less than the space between the adjacent grooves.

The plate 131 will be described in detail.

If the depth and width of the bottomed grooves 131*c* of each plate 131 are respectively set equal to or smaller than 0.005 mm and equal to or smaller than 0.005 mm, the tight contact preventive effect cannot be obtained sufficiently. If the depth and width of the bottomed grooves 131*c* of each plate 131 are respective set equal to or larger than 0.2 mm and equal to or larger than 0.3 mm, a uniform printing pressure cannot be obtained between the blanket cylinder 104 and impression cylinder 105, leading to a printing trouble. Hence, it is desirable that the depth and width of the bottomed grooves 131*c* be respectively set to fall within a range of 0.005 mm to 0.2 mm and a range of 0.005 mm to 0.3 mm.

Figure 6:
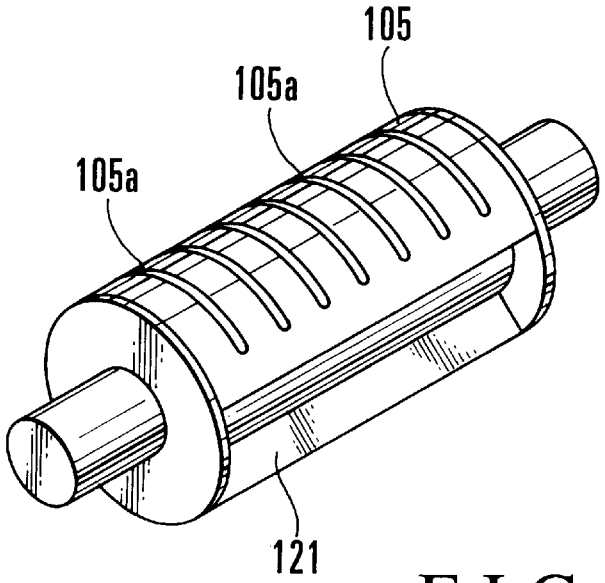
FIG. 6 is a perspective view showing an example wherein a plurality of grooves that are parallel to each other are formed in the circumferential surface of the impression cylinder.

In this embodiment, the plates 131 are mounted on the circumferential surface of the impression cylinder 105. As shown in FIG. 6, a plurality of grooves 105*a* that are parallel to each other may be directly formed in the circumferential surface of an impression cylinder 105. In this case, the plates 131 become unnecessary. In the present invention, the plates 131 are mounted on the impression cylinder 105. If a transfer cylinder is arranged on the upstream side to be in contact with the convertible cylinder 107, plates 131 may be mounted on the transfer colinear which may also be called a paper convey cylinder or bottomed grooves 131*c* may be directly formed in the circumferential surface of the transfer cylinder, as a matter of course.

In fine, the plates 131 may be mounted on the upstream paper convey cylinder which is in contact with the convertible cylinder 107, or the bottomed grooves 131*c* may be formed in this paper convey cylinder. In particular, when the upstream paper convey cylinder which is in contact with the convertible cylinder 107 is the impression cylinder 105, a printing pressure is applied to the paper sheet 112 wound on the impression cylinder 105, so that the paper sheet 112 is difficult to separate from the impression cylinder 105. If the present invention is applied to the impression cylinder 105 arranged on the upstream side of the convertible cylinder 107, as described in this embodiment, a conspicuous effect can be obtained in prevention of defective printing or a printing trouble.

It is desirable that the plurality of bottomed grooves 131*c* be formed to extend in the winding direction of the plates 131, i.e., in the circumferential direction of the impression cylinder 105, to be parallel to each other. However, the present invention is not limited to this. For example, a bottomed groove may be formed spirally in the circumferential direction of the impression cylinder 105. Also, the shape of the grooves is not limited to what is adopted in the present invention, but recessed grooves may be sparsely formed on the outer circumferential surface of the impression cylinder 105. Regarding the grooves, various design modifications may be made. If the thickness of the plates 131 is equal to or smaller than 0.2 mm, through holes extending through the bottom portions of the bottomed grooves 131*c* may be formed.

Referring to FIG. A, according to one embodiment, the plate 131 comprises a plurality of divisional plates 141 where the divisional plates are mounted on the circumferential surface of the paper convey cylinder equidistantly in a circumferential direction.

As has been described above, according to the present invention, when the paper sheet is gripped by the convertible cylinder, the portion between the paper sheet and the outermost circumferential surface of the paper convey cylinder is prevented to be set in a vacuum state, so that generation of a negative pressure that interferes with the paper sheet from separating from the upstream paper convey cylinder is prevented. Since the contact area between the paper sheet and the outermost circumferential surface of the upstream convey cylinder is also decreased, the contact resistance against the paper sheet, which occurs when the paper sheet is separated from the circumferential surface of the paper convey cylinder and comes into slidable contact with the outermost circumferential surface thereof, is decreased.

When the paper sheet is gripped by the convertible cylinder, no strong force that pulls back the paper sheet to the paper convey cylinder side is applied to the paper sheet. Therefore, paper sheet gripping failure can be prevented. As a result, the paper sheet is prevented from dropping into the printing press or being left wound on the upstream paper convey cylinder, thereby preventing occurrence of a printing trouble or defective printing.

When the tight contact force of the paper sheet with respect to the paper convey cylinder located on the upstream side of the convertible cylinder differs depending on the thickness, quality, or the like of the paper, it suffices if the plates are exchanged for those having recesses with a different shape or a different number of recesses. Therefore, exchange of the upstream paper convey cylinder itself becomes unnecessary, which is economical.

Along with rotation of the paper convey cylinder located on the upstream side of the convertible cylinder, air present between the paper sheet and the circumferential surface of the paper convey cylinder flows in the grooves smoothly. This allows better separation of the paper sheet.

What is claimed is:

1. A sheet-fed offset printing press with a convertible press mechanism, comprising:

a convertible cylinder for conveying a paper sheet in a converted state downstream in a paper convey direction;

a paper convey cylinder which is in contact with said convertible cylinder on an upstream side with respect to the paper convey direction and conveys the paper sheet to said convertible cylinder;

a convertible press mechanism provided to said convertible cylinder to separate the paper sheet wound on a circumferential surface of said paper convey cylinder and to convert the separated paper sheet; and a plurality of recesses provided between a circumferential surface of said paper convey cylinder and the paper sheet wound on said circumferential surface of said paper convey cylinder, said plurality of recesses including elongated grooves extending in the circumferential direction of the paper convey cylinder and having a width substantially less than the space between adjacent grooves.

2. A printing press according to claim 1, further comprising a plate mounted on said circumferential surface of said paper convey cylinder and having a surface with which the paper sheet under conveyance comes into direct contact, and wherein said recesses are formed in said surface of said plate.

3. A printing press according to claim 2, wherein said plate comprises a plurality of divisional plates, and said divisional plates are mounted on said circumferential surface of said paper convey cylinder equidistantly in a circumferential direction.

4. A printing press according to claim 2, further comprising a first gap and a second gap formed in said paper convey cylinder extending in an axial direction, a first fixing mechanism provided in said first gap to fix one end of said plate, and a second fixing mechanism provided in said second gap to fix the other end of said plate mounted on said circumferential surface of said paper convey cylinder.

5. A printing press according to claim 1, wherein said recesses are directly formed in said surface of said paper convey cylinder to which the paper sheet under conveyance comes into contact.

6. A printing press according to claim 1, wherein said elongated grooves are formed parallel to each other.

7. A printing press according to claim 1, wherein said convertible press mechanism comprises a sucker unit for drawing a paper trailing end of the paper sheet conveyed from said paper convey cylinder, and a gripper unit for gripping the paper trailing end of the paper sheet drawn by said sucker unit, thereby converting the paper sheet.

8. A printing press according to claim 1, wherein said recesses have depth of 0.005 to 0.2 mm and width of 0.005 to 0.3 mm.

9. A sheet-fed offset printing press with a convertible press mechanism, comprising:

a convertible cylinder for conveying a paper sheet in a converted state downstream in a paper convey direction;

a paper convey cylinder which is in contact with said convertible cylinder on an upstream side in the paper convey direction and conveys the paper sheet to said convertible cylinder;

a convertible press mechanism provided to said convertible cylinder to separate the paper sheet wound on a circumferential surface of said paper convey cylinder and to convert the separated paper sheet;

a plate mounted on a circumferential surface of said paper convey cylinder, the paper sheet under conveyance being wound on said circumferential surface of said paper convey cylinder through said plate; and a plurality of elongated grooves formed in a surface of said plate mounted on said circumferential surface of said paper convey cylinder, to be parallel to each other and having a width substantially less than the space between adjacent grooves.

10. A sheet-fed offset printing press with a convertible press mechanism, comprising;

a convertible cylinder for conveying a paper sheet in a converted state downstream in a paper convey direction;

a paper convey cylinder which is in contact with said convertible cylinder on an upstream side in the paper convey direction and conveys the paper sheet to said convertible cylinder;

a convertible press mechanism provided to said convertible cylinder to separate the paper sheet wound on a circumferential surface of said paper convey cylinder and to convert the separated paper sheet; and a plurality of elongated grooves formed in a circumferential surface of said paper convey cylinder on which the paper sheet under conveyance is wound, to be parallel to each other and having a width substantially less than the space between adjacent grooves.

* * * * *

UNITED STATES PATENT AND TRADEMARK OFFICE

CERTIFICATE OF CORRECTION

PATENT NO. : 5,927,198
DATED : July 27, 1999
INVENTOR(S) : Tada

It is certified that error appears in the above-identified patent and that said Letters Patent is hereby corrected as shown below:

Title page,
Item [54], Title, delete "SHEET-FED OFFSET PRINTING PRESS WITH GROOVED PAPER CONVEY CYLINDER" and insert -- SHEET-FED OFFSET PRINTING PRESS WITH CONVERTIBLE PRESS MECHANISM --.

Signed and Sealed this

Fifth Day of March, 2002

*Attest:*

*Attesting Officer*

JAMES E. ROGAN
*Director of the United States Patent and Trademark Office*